US006817474B2

(12) United States Patent
Ikeda et al.

(10) Patent No.: US 6,817,474 B2
(45) Date of Patent: Nov. 16, 2004

(54) COLOR SORTING APPARATUS FOR GRANULAR OBJECTS WITH FUNCTION TO SORTING OUT FOREIGN MAGNETIC METAL MATTERS

(75) Inventors: Norimasa Ikeda, Tokyo (JP); Hiroshi Tanimoto, Tokyo (JP)

(73) Assignee: Satake Corporation, Toyko (JP)

( * ) Notice: Subject to any disclaimer, the term of this patent is extended or adjusted under 35 U.S.C. 154(b) by 168 days.

(21) Appl. No.: 10/308,496

(22) Filed: Dec. 3, 2002

(65) Prior Publication Data

US 2003/0127366 A1 Jul. 10, 2003

(30) Foreign Application Priority Data

Dec. 6, 2001 (JP) ..... 2001-373345

(51) Int. Cl.[7] ..... B03C 1/00; B07C 5/342; B07C 5/00

(52) U.S. Cl. ..... 209/223.2; 209/638; 209/639; 209/644; 209/580; 209/577; 209/636; 209/226

(58) Field of Search ..... 209/638, 639, 209/644, 580, 577, 578, 579, 576, 636, 223.1, 223.2, 226–227

(56) References Cited

U.S. PATENT DOCUMENTS

| | | | | | |
|---|---|---|---|---|---|
| 2,504,731 | A | | 4/1950 | Rose et al. | |
| 2,587,686 | A | | 3/1952 | Barry | |
| 2,680,517 | A | * | 6/1954 | Koerner | 209/219 |
| 3,701,419 | A | * | 10/1972 | Hutter et al. | 209/570 |
| 3,738,484 | A | | 6/1973 | Hoover et al. | |
| 3,749,240 | A | * | 7/1973 | Spears et al. | 209/631 |
| 3,802,558 | A | | 4/1974 | Rhys | |
| 3,990,581 | A | | 11/1976 | Tengsater | |
| 4,088,227 | A | | 5/1978 | Lockett | |
| 4,099,620 | A | | 7/1978 | Kendall et al. | |
| 4,231,478 | A | | 11/1980 | Stone | |
| 4,236,640 | A | | 12/1980 | Knight | |
| 4,314,645 | A | | 2/1982 | Perkins, III et al. | |
| 4,319,269 | A | | 3/1982 | Kajiura et al. | |
| 4,367,817 | A | * | 1/1983 | Satake | 209/580 |
| 4,420,390 | A | * | 12/1983 | Carr | 209/216 |
| 4,466,544 | A | * | 8/1984 | Satake et al. | 209/580 |
| 4,520,702 | A | | 6/1985 | Davis et al. | |
| 4,576,482 | A | | 3/1986 | Pryor | |
| 4,581,632 | A | | 4/1986 | Davis et al. | |
| 4,718,559 | A | * | 1/1988 | Kenny et al. | 209/571 |
| 4,738,175 | A | | 4/1988 | Little et al. | |
| 4,829,380 | A | | 5/1989 | Iadipaolo | |
| 4,853,533 | A | | 8/1989 | Little et al. | |
| 4,896,836 | A | * | 1/1990 | Mitchell | 241/81 |
| 4,906,099 | A | | 3/1990 | Casasent | |
| 5,060,290 | A | | 10/1991 | Kelly et al. | |
| 5,090,574 | A | | 2/1992 | Hamby | |
| 5,119,205 | A | | 6/1992 | Lemleson | |
| 5,151,822 | A | | 9/1992 | Hekker et al. | |
| 5,197,607 | A | | 3/1993 | Håkansson | |
| 5,283,641 | A | | 2/1994 | Lemleson | |
| 5,318,173 | A | | 6/1994 | Datari | |
| 5,335,293 | A | | 8/1994 | Vannelli et al. | |
| 5,487,472 | A | | 1/1996 | Satake et al. | |
| 5,509,537 | A | | 4/1996 | Crismon et al. | |
| 5,526,437 | A | | 6/1996 | West | |
| 5,659,624 | A | | 8/1997 | Fazzari et al. | |
| 5,779,058 | A | * | 7/1998 | Satake et al. | 209/581 |

* cited by examiner

*Primary Examiner*—Donald P. Walsh
*Assistant Examiner*—Jonathan R Miller
(74) *Attorney, Agent, or Firm*—Wells St. John P.S.

(57) ABSTRACT

A magnetic metal removing device for color sorting apparatus includes a hollow feeding roll. Within a hollow portion of the feeding roll, a magnet is arranged such that it closely opposes to a part of an inner surface of the hollow feeding roll to form a magnetic force active surface on the corresponding outer surface of the feeding roll. Magnetic metal mixed in raw granular objects is attracted on the magnetic force active surface. The magnetic forced active surface changes to a magnetic force inactive surface as the feeding roll rotates. The magnetic metal caught on the feeding roll is released from the magnetic forced inactive surface and colleted by a collecting device.

2 Claims, 3 Drawing Sheets

COLOR SORTING APPARATUS FOR GRANULAR OBJECTS WITH FUNCTION TO SORTING OUT FOREIGN MAGNETIC METAL MATTERS

RELATED APPLICATION

This application relates to and claims a priority from the corresponding Japanese Patent Application No. 2001-373345 filed on Dec. 6, 2001.

BACKGROUND OF THE INVENTION

1. Field of the Invention

The present invention relates to a color sorting apparatus for granular objects such as wheat or rice grains and resin pellets in which colored objects or foreign matters mixed in the raw granular objects are sorted out, and more particularly to a color sorting apparatus which is further capable of sorting out such magnetic metal as an iron piece also mixed in the raw granular objects.

2. Description of the Related Art

A typical conventional color sorting apparatus to which the present invention relates comprises a storage hopper for storing therein raw granular objects; a transferring means which includes a vibration feeder arranged beneath the storage hopper and an inclined or slanted flow chute arranged at an exit side of the vibration feeder; at least one optical detection means which is arranged around a falling locus of the raw granular objects released from a lowermost end of the inclined flow chute and which is constituted by a light source, a background and a light receiving sensor; a determination means which outputs an ejection signal based on an optical detection signal from the light receiving sensor; and a sorting means which sorts out a detected unacceptable granular object upon receipt of the ejection signal from the determination means. In the above color sorting apparatus, each raw granular object naturally falling down along the falling locus of the granular objects is illuminated by the light source, the determination means determines the existence of the granular objects to be sorted out based on the changes in the light amount obtained from each granular object, and the granular objects determined as unacceptable ones are sorted out by the sorting means. In this way, the colored granular objects and the foreign matters are removed from the acceptable granular objects. However, among the foreign matters, magnetic metal such as an iron piece cannot be effectively removed by the above conventional color sorting apparatus.

A color sorting apparatus equipped with a device for removing magnetic metal pieces mixed in the raw granular objects which pieces cannot otherwise be removed by the conventional color sorting apparatus is disclosed in, for example, Japanese Utility Model Registration Publication No. Sho 56-277. The publication discloses a color sorting apparatus in which a magnet is suspended over the flow passage of the vibration feeder with a predetermined distance kept from the bottom part of the flow passage in such a manner that any magnetic metal piece is magnetically attracted and removed from the flow of raw granular objects to prevent such magnetic metal piece from flowing to the following flow chute.

However, there has been a following problem in the color sorting apparatus disclosed in the above publication. The removal of the magnetic metal pieces that have been attracted by and caught on the magnet suspended within the vibration feeder should be performed under the condition that the magnet itself is once taken out outside the apparatus after the arm member suspending the magnet is pivotally rotated about the axis thereof. Since the interruption of the transferring of the raw granular objects during the removal operation of the magnetic metal is necessitated in the above conventional method, there is a problem in that the operation efficiency of the granular object color sorting apparatus is inevitably lowered.

SUMMARY OF THE INVENTION

An object of the present invention, therefore, is to overcome the problems existing in the prior art, and to provide a granular object color sorting apparatus which is capable of effectively sorting out any magnetic metal pieces mixed in the raw granular objects without lowering the operation efficiency of the color sorting apparatus.

According to one aspect of the invention, there is provided a color sorting apparatus for granular objects, comprising:

a storage hopper for storing therein raw granular objects;

a transferring means for transferring the raw granular objects consecutively to an optical detection point, the transferring means including a magnetic metal removing means having a hollow feeding roll for sending out the raw granular objects stored in the storage hopper; a magnet arranged within the hollow portion of said feeding roll at a raw granular object sending-out side of the feeding roll such that the magnet closely opposes to a part of an inner surface of the feeding roll so as to form a magnetic force active surface on a corresponding part of an outer surface of the feeding roll, the magnetic force active surface attracting magnetic metal mixed in the raw granular objects; and a magnetic metal piece collecting means for collecting the magnetic metal which is released from the outer surface of the feeding roll other than said magnetic force active surface;

an optical detection means arranged around a falling locus of the raw granular objects released from the transferring means, the optical detection means comprising an illuminating means, a background plate and a light receiving sensor for receiving light from the background plate and each of the raw granular objects at the optical detection point, the illuminating means irradiating the background plate and the granular object at the optical detection point;

a determination means for determining as to whether each of the raw granular objects is an acceptable one or an unacceptable one which should be sorted out based on the comparison between a light received signal from the light receiving sensor and a predetermined threshold value, and for outputting an ejection signal when determined as an unacceptable one; and a sorting means for sorting out the unacceptable one in accordance with the ejection signal from the determination means.

BRIEF DESCRIPTION OF THE DRAWINGS

The above and other objects, features and advantages of the present invention will be apparent from the following description of a preferred embodiment of the invention explained with reference to the accompanying drawings, in which.

PREFERRED EMBODIMENT OF THE INVENTION

Figure 1:
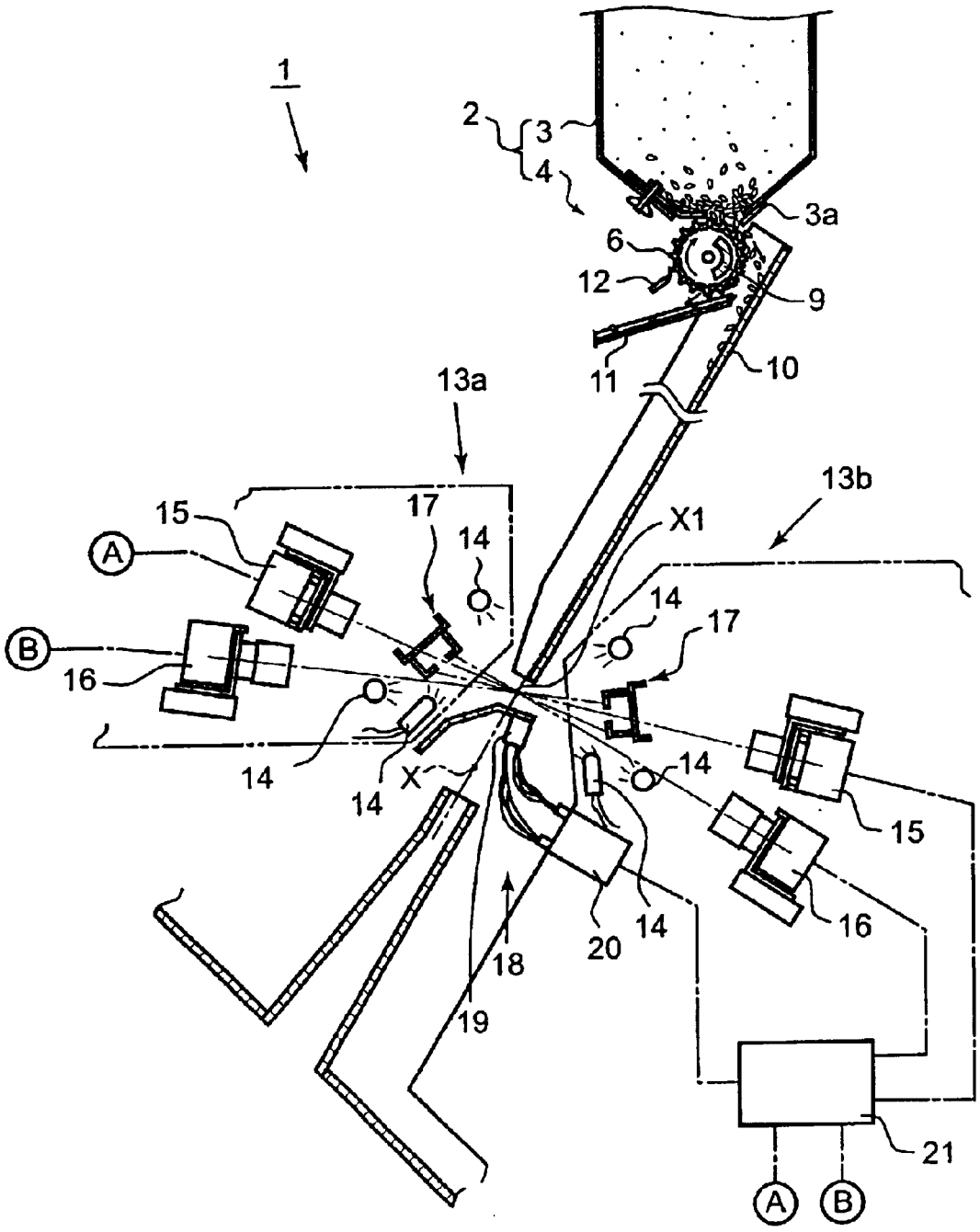
FIG. 1 is a side sectional view of the granular object color sorting apparatus according to the invention.
Figure 2:
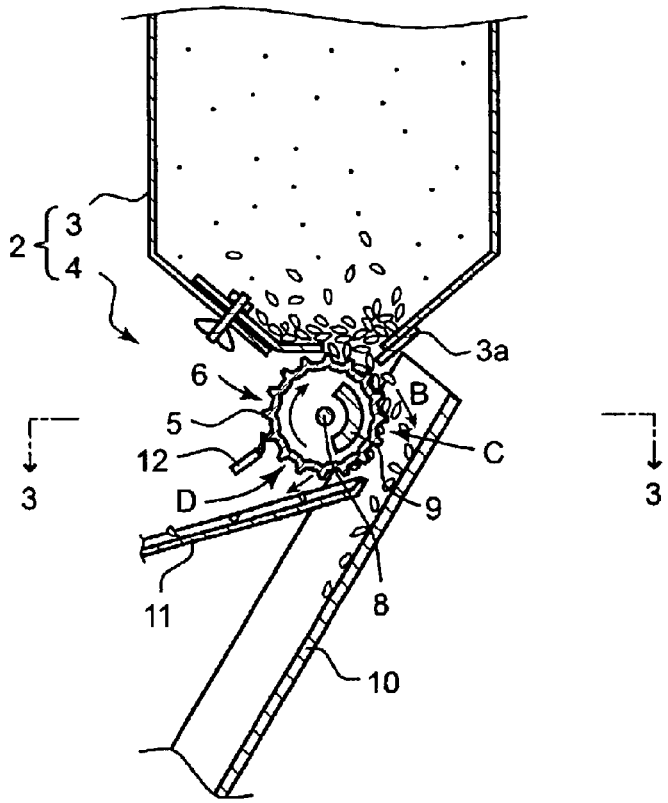
FIG. 2 is a side sectional view of the object supply means of FIG. 1 color sorting apparatus.
Figure 3:
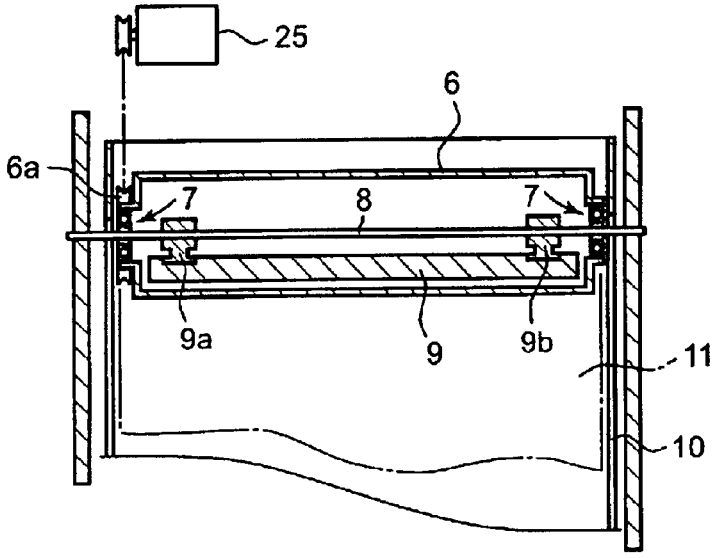
FIG. 3 is a sectional view taken along 3—3 line in FIG. 2.

Now, a preferred embodiment according to the invention is explained with reference to the accompanying drawings. FIG. 1 shows a side sectional view of a color sorting apparatus 1 for granular objects according to the present invention. FIG. 2 shows a side sectional view of an object supply means 2 explained later. The object supply means 2 is constituted by a storage hopper 3 and a rotary feeder 4 arranged at an outlet port of the lower portion of the storage hopper 3. The rotary feeder 4 comprises a hollow feeding roll 6 which is made of magnetic material and which has an uneven or jagged peripheral outer surface 5 therearound for feeding or sending out the granular objects. The feeding roll 6 is rotatably mounted by a pair of bearings 7, 7 at both end portions of the fixed center shaft 8 longitudinally extending within the roll 6 and extending out from both the ends of the feeding roll 6. One end of the feeding roll 6 is fixedly provided with a pulley 6*a* as shown in FIG. 3. The pulley 6*a* is connected to the drive shaft of the motor 25 through an appropriate belt so that it is driven by the motor 25. In this way, the feeding roll 6 is driven to rotate around the center shaft 8 upon driven by the motor 25. Further, within the hollow portion of the feeding roll 6, there is provided a stationary magnet 9 adjacent the side where the granular objects supplied from the storage hopper 3 are fed out. The magnet 9 is connected to the nonrotatable fixed center shaft 8 though a pair of fixing members 9*a*, 9*b* (see FIG. 3) at substantially end portions thereof so that the outer curved surface of the magnet 9 closely opposes to the inner wall surface of the feeding roll 6. A transferring means in this description means the above explained object supply means 2 and the flow chute 10. In FIG. 3, for the purpose of simplicity, a scraper 12 which will be explained later is omitted.

Underneath the feeding roll 6, there is provided a slanted or inclined flow chute 10 which receives the fed out raw granular objects and on which they naturally flow down. Adjacent a part of the outer surface of the feeding roll 6, which part is away from the magnet 9, that is, adjacent a magnetic force inactive surface D, there is arranged a magnetic metal collecting means. In the illustrated embodiment, the magnetic metal collecting means is constituted by a magnetic metal collecting chute 11 which extends out from a portion between the feeding roll 6 and the flow chute 10 and is inclined in the same direction as that of the flow chute 10. The sorted out magnetic metal pieces are collected by the magnetic metal collecting chute 11 and transferred to an appropriate collecting box (not shown) therethrough. The magnetic metal collecting means may well be constituted by a mere collecting box as the simplest example or a suction means other than the illustrated example. Further, with respect to a portion of the magnetic force inactive surface D of the feeding roll 6, there is provided a scraper 12 for self-cleaning of the outer circumferential surface of the feeding roll 6. At the bottom outlet port of the storage hopper 3, there is provided an adjusting plate 3*a* for adjusting the opening area of the outlet port.

Around the falling locus X of the granular objects released from the lowermost end of the flow chute 10, there are provided an optical detection means 13 (13*a*, 13*b*) and a sorting means 18. The optical detection means 13 comprises a first optical detection means 13*a* arranged at one side of the falling locus X and a second optical detection means 13*b* arranged at the other side of the falling locus X. Each of the optical detection means 13*a* and 13*b* comprises an illumination means 14 such as a fluorescent lamp or a halogen lamp for irradiating the granular objects; a visible light receiving sensor 15 for detecting the colored objects; a near-infrared light receiving sensor 16 for detecting such foreign matters as a stone or a glass; and a background 17 arranged at a portion of the falling locus X where each sensor 15, 16 views through the optical detection point X1. The sorting means 18 comprises an air jet nozzle 19 which is arranged at a portion along the falling locus X below the optical detection point X1, an air supply means 20 connected to the air jet nozzle 19 through an appropriate conduit, and a compressor (not shown) connected to the air supply means 20.

Now, the determination means 21 is explained. The determination means 21 comprises a central processing unit (CPU) as a main element. The determination means 21 further comprises an input/output device to which the visible light receiving sensor 15, the near-infrared light receiving sensor 16 and the air supply means 20 are connected. The determination means 21 further comprises a memory device in which predetermined threshold values for determining the unacceptable granular objects (e.g., colored objects and/or foreign matters) which are to be sorted out are stored. The determination means 21 determines as to whether each granular object is acceptable or not by comparing the detection signals from the visible light receiving sensor 15 and the near-infrared light receiving sensor 16 with the above threshold values, and then sends out an ejection signal to the air supply means 20 so that this particular granular object, that is, the colored object or the foreign matter which should be sorted out is ejected by a jet air.

Next, operation of the granular object color sorting apparatus according to the invention will be explained. The raw granular objects in the storage hopper 3 are consecutively sent out, in the direction B in FIG. 2, from the uneven surface 5 of the feeding roll 6 by the rotation of the rotary feeder 4, and the granular objects thus sent out fall on the flow chute 10 and flow thereon downwardly. As explained above, since the granular object sending-out side (hereinafter referred to as "magnetic force active surface C") of the feeding roll 6 has a magnetic force which is generated by the magnet 9 fixedly and closely arranged to oppose to the corresponding portion of the inner surface of the feeding roll 6, any magnetic metal pieces mixed in the raw granular objects are attracted to the magnetic force active surface C. The magnetic force active surface C changes to the magnetic force inactive surface D as the feeding roll 6 rotates by about 120 degrees. When the part of the outer surface of the feeding roll 6, which part has been the magnetic force active surface C, changes to the magnetic force inactive surface D in accordance with the rotation of the feeding roll 6, the magnetic force thereat vanishes. As a result, the magnetic metal pieces that have been attracted to the surface of the feeding roll 6 fall on the magnetic metal collecting chute 11 because of the vanishing of the magnetic force when the magnetic force active surface changes to the magnetic force inactive surface in accordance with the rotation of the feeding roll 6. The magnetic metal pieces fell on the chute 11 flow thereon downwardly. In the case where there remains any magnetic metal piece on the feeding roll 6 without dropping on the magnetic metal collecting chute 11, such magnetic metal pieces are forcibly scraped down by the scraper 12. In this way, since the magnetic metal pieces mixed in the raw granular objects, which have been once attracted by the rotary feeder 4, are released from the magnetic force inactive surface D and collected, it is not necessary to interrupt the operation of the rotary feeder 4 otherwise has been necessary to remove the attracted magnetic metal piece from the magnet, whereby the operation efficiency never goes down.

The raw granular objects fell down on the flow chute 10 are released from the lowermost end of the flow chute 10 along the falling locus X. The visible light receiving sensor 15 and the near-infrared light receiving sensor 16 detect the light from the raw granular object just arriving at the optical detection position X1. The determination means 21 compares the detected values from the visible light receiving sensor 15 and the near-infrared light receiving sensor 16 with the predetermined threshold values and determines, based on this comparison, as to whether this particular granular object is acceptable one or a colored or a foreign matter which should be sorted out. If the granular object is determined as unacceptable, the determination means 21 sends out a corresponding ejection signal to the air supply means 20 of the sorting means 18. In response to this ejection signal, the air supply means 20 supplies air to the air jet nozzle 19, whereby the colored object or the foreign matter is sorted out by jet air. As explained above, according to the granular object color sorting apparatus of the invention, in addition to the removal of the colored objects and such foreign matters as stones or glass pieces, it is possible to effectively remove any magnetic metal pieces mixed in the raw granular objects.

Figure 4:
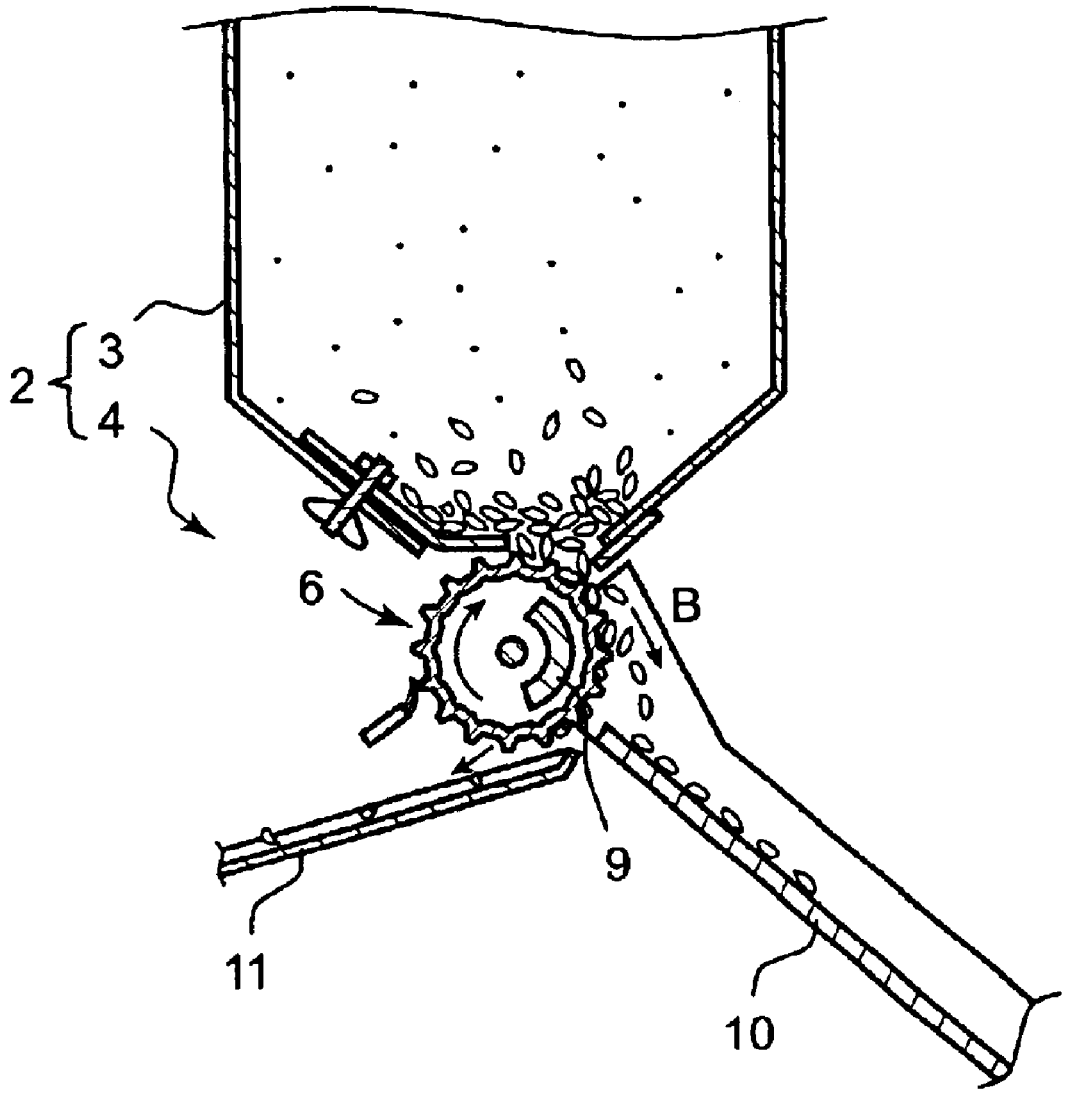
FIG. 4 is a side sectional view of the object supply means of a modified embodiment.

As shown in FIG. 4, as a modified embodiment, the flow chute 10 may well be inclined in the direction where the granular objects are sent out from the feeding roll 6.

As explained hereinabove, according to the invention, it is possible to cause the raw granular object sending-out side of the feeding roll to be a magnetic force active surface having magnetic force by closely positioning a magnet behind the inner wall of the feeding roll. In this way, any magnetic metal pieces mixed in the raw granular objects are attracted by the above magnetic force active surface when they are sent out from the storage hopper and, thereafter, the attracted magnetic metal pieces are released from the feeding roll in accordance with the rotation of the feeding roll and collected when the magnetic force active surface changes to the magnetic force inactive surface whose position is far from the magnet. For the removal of the magnetic metal pieces once attracted on the feeding roll, since it is not necessary to interrupt the operation of the feeding roll, no lowering of the operation efficiency occurs. Further, in the case where the scraper in touch with the surface of the feeding roll is provided, any magnetic metal pieces remain and adhere on the surface without having been released can be scraped out and collected. Such scraper also serves as a self-cleaning means for removing any contamination adhered on the surface of the feeding roll.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A color sorting apparatus for granular objects, comprising:

a storage hopper for storing therein raw granular objects;

a transferring means for transferring said raw granular objects consecutively to an optical detection point, said transferring means including a magnetic metal removing means having a hollow feeding roll for sending out said raw granular objects stored in said storage hopper; a magnet arranged within said hollow portion of said feeding roll at a raw granular object sending-out side of said feeding roll such that said magnet closely opposes to a part of an inner surface of said feeding roll so as to form a magnetic force active surface on a corresponding part of an outer surface of said feeding roll, said magnetic force active surface attracting magnetic metal mixed in said raw granular objects; and a magnetic metal piece collecting means for collecting said magnetic metal which is released from the outer surface of said feeding roll other than said magnetic force active surface;

an optical detection means arranged around a falling locus of said raw granular objects released from said transferring means, said optical detection means comprising an illuminating means, a background plate and a light receiving sensor for receiving light from said background plate and each of said raw granular objects at said optical detection point, said illuminating means irradiating said background plate and said granular object at said optical detection point;

a determination means for determining as to whether each of said raw granular objects is an acceptable one or an unacceptable one which should be sorted out based on the comparison between a light received signal from said light receiving sensor and a predetermined threshold value, and for outputting an ejection signal when determined as an unacceptable one; and a sorting means for sorting out said unacceptable one in accordance with said ejection signal from said determination means.

2. A color sorting apparatus for granular objects according to claim 1, further comprising a scraper which is in touch with an outer surface of said feeding roll.

* * * * *